US005231692A

United States Patent [19]

Tanaka et al.

[11] Patent Number: 5,231,692

[45] Date of Patent: Jul. 27, 1993

[54] PITCH PERIOD SEARCHING METHOD AND CIRCUIT FOR SPEECH CODEC

[75] Inventors: Yoshinori Tanaka, Kawasaki; Tomohiko Taniguchi, Yokohama; Akira Sasama, Fuji; Yasuji Ohta, Yokohama; Fumio Amano, Tokyo; Shigeyuki Unagami, Atsugi, all of Japan

[73] Assignee: Fujitsu Limited, Kawasaki, Japan

[21] Appl. No.: 593,756

[22] Filed: Oct. 5, 1990

[30] Foreign Application Priority Data

Oct. 5, 1989 [JP] Japan ..... 1-260531

[51] Int. Cl.[5] ..... G10L 9/00

[52] U.S. Cl. ..... 395/2

[58] Field of Search ..... 381/29-40, 381/49, 51; 395/2

[56] References Cited

U.S. PATENT DOCUMENTS 4,004,096 1/1977 Bauer et al. ..... 381/49
4,924,508 5/1990 Crepy et al. ..... 381/38
4,933,957 6/1990 Bottau et al. ..... 381/29
5,012,517 3/1991 Wilson et al. ..... 381/36

FOREIGN PATENT DOCUMENTS

0331857A1 9/1989 European Pat. Off. .

OTHER PUBLICATIONS

Hess, "Pitch Determination of Speech Signals", Springer-Verlag, 1983, pp. 373-383.
Parsons, "Voice and Speech Processing", McGraw-Hill Book Co., 1986, pp. 219-221.

*Primary Examiner*—Allen R. MacDonald
*Assistant Examiner*—Michelle Doerrler
*Attorney, Agent, or Firm*—Staas & Halsey

[57] ABSTRACT

Pitch periods for a long term predictor included in a speech codec are searched in two searching stages. In the first searching stage, probable pitch periods are searched skipping a constant number of pitch periods, and in the second searching stage, pitch periods including the pitch period determined in the first searching stage and pitch periods neighboring the pitch period on both sides are searched.

10 Claims, 5 Drawing Sheets

PITCH PERIOD SEARCHING METHOD AND CIRCUIT FOR SPEECH CODEC

BACKGROUND OF THE INVENTION

1. Field of the Invention

The present invention relates to a method and a circuit for searching for a pitch period of a speech signal to determine coefficients for a long term predictor which is used in a coder and decoder (codec) for speech signals.

2. Description of the Related Art

Recently, high performance speech coding, wherein speech signals can be transmitted at low bit rates without remarkably degrading quality of the speech signals, have been required in local communication systems, digital mobile communication systems, and the like.

In several types of speech coding, for example, code-excited linear predictive coding (CELP), residual-excited linear predictive coding (RELP), and multi-pulse excited linear predictive coding (MPC), a long term predictor (pitch predictor) is used for performing long term prediction based on periodicity of a speech signal.

Coefficients for the long term predictor are determined by minimizing a total squared prediction error after pitch prediction. Accordingly, the total squared prediction error for all pitch periods which are probable in speech signals had to be estimated to find the most adequate coefficients for each speech signal block. Therefore, the number of arithmetic operations becomes enormous and the scale of required hardware becomes large.

SUMMARY OF THE INVENTION

It is an object of the present invention to provide a method and a circuit which require a relatively small number of arithmetic operations and relatively small size hardware.

In accordance with the present invention there is provided a pitch period searching method for searching pitch periods, which are probable in speech signals, for the most adequate pitch period for a long term predictor included in a speech codec, comprising the steps of: searching the probable pitch periods skipping a first number of pitch periods, to find the most adequate pitch period among the searched pitch periods, and searching a second number of pitch periods including the pitch period and pitch periods neighboring the pitch period on both sides, to find the most adequate pitch period among the second number of pitch periods.

In accordance with the present invention there is also provided a pitch period searching circuit for searching pitch periods which are probable in speech signals for the most adequate pitch period for a long term predictor included in a speech codec, comprising arithmetic means for estimating suitability of the pitch period, the circuit further comprising: searching means for searching the probable pitch periods skipping a first number of pitch periods, to find the most adequate pitch period among the searched pitch periods based on estimation by the arithmetic means, in response to a first search command, and for searching a second number of pitch periods including the above pitch period and pitch periods neighboring the pitch period on both sides, to find the most adequate pitch period among the second number of pitch periods based on estimation by the arithmetic means, in response to a second search command.

DESCRIPTION OF THE PREFERRED EMBODIMENTS

Before describing the preferred embodiments according to the invention, examples of aforementioned related art are given with reference to the accompanying drawings.

Figure 1:
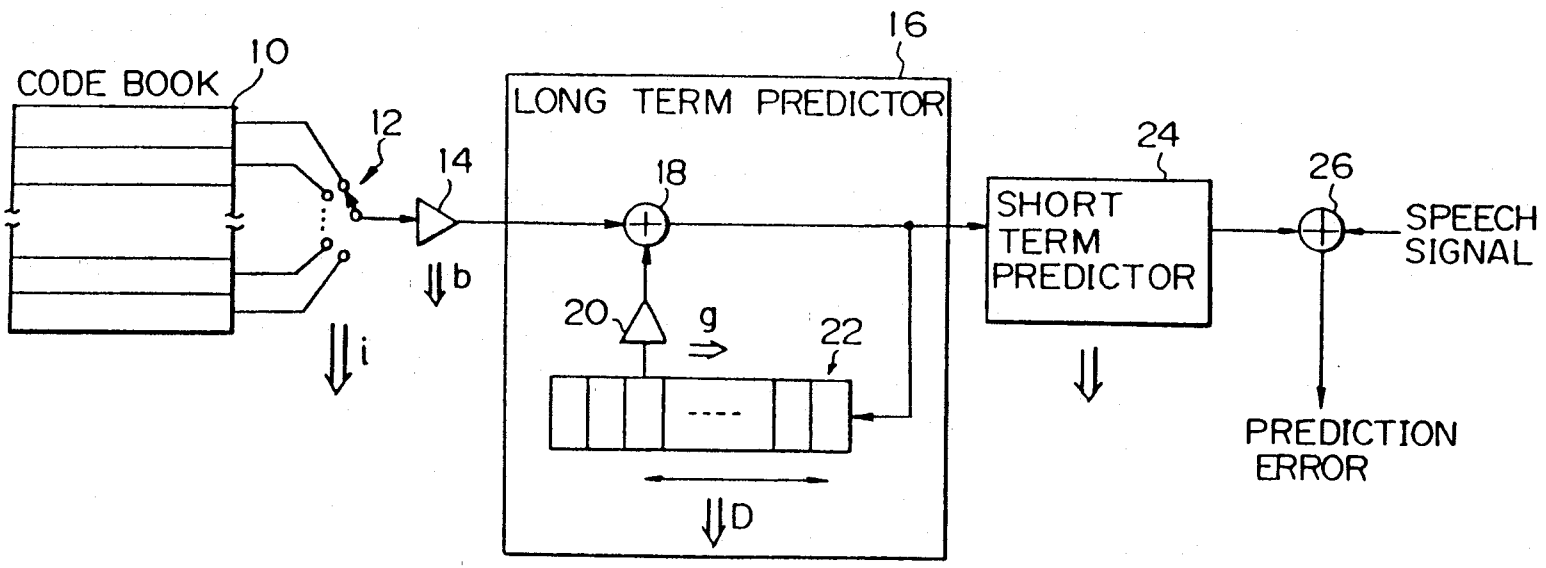
Fig. 1 PRIOR ART
FIG. 1 is a block diagram representing a general construction of a CELP coder as an example of speech coders having a long term predictor.

FIG. 1 is a block diagram showing a general construction of a speech coder using CELP as an example of speech coders having a long term predictor 16.

A plurality of stochastic signals are stored in a codebook 10. One of the stochastic signals is selected by a switch 12 according to a number i, is multiplied by a coefficient b in a multiplier 14, and passes through the long term predictor 16 and a short term predictor 24. A prediction error is estimated by subtracting the output of the short term predictor 24 from a speech signal in a subtracter 26. Coefficients for the short term predictor 24 are determined by LPC analysis of the speech signal. Also, the number i, gain b, gain g of a multiplier 20 in the long term predictor 16, and delay time D of a shift register 22 in the long term predictor 16 are determined by minimizing the total squared prediction error over a speech signal block. These coefficients are transmitted as a code block representing the speech signal block.

In a decoder side, the speech signal blocks are sequentially reproduced based on received code blocks, and thus speech signals are reproduced.

Figure 2:
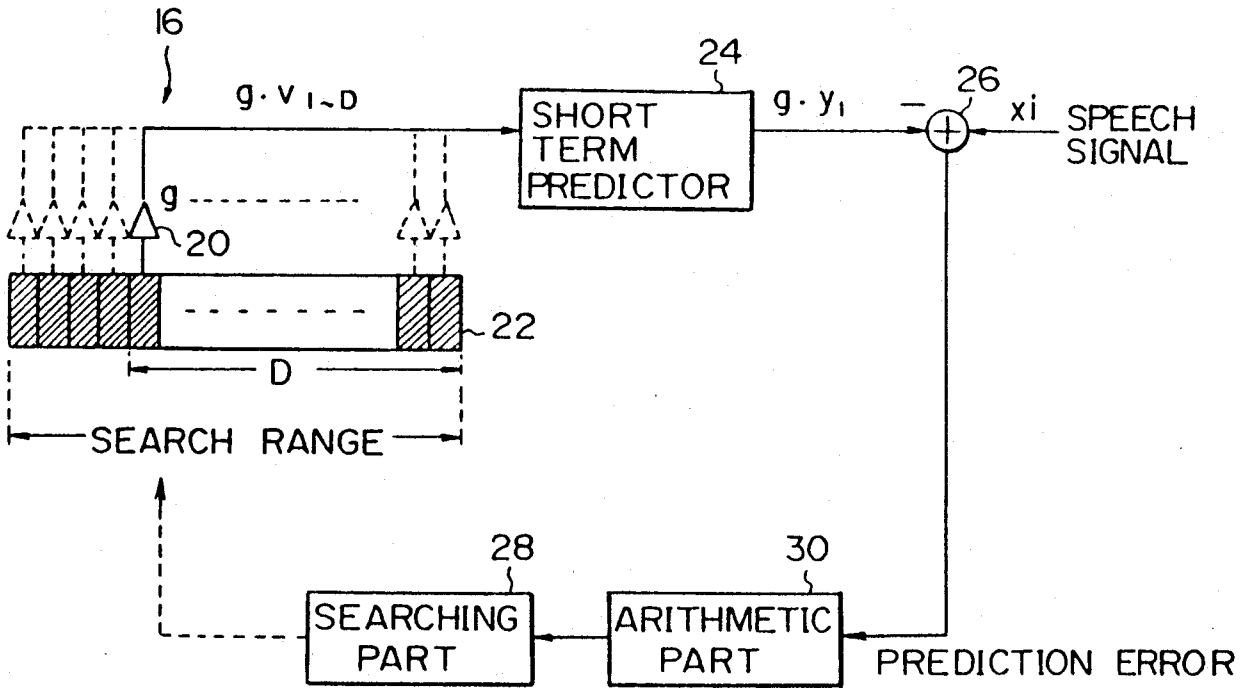
Fig. 2 PRIOR ART
FIG. 2 is a block diagram representing a conventional searching process of pitch periods for the long term predictor.

FIG. 2 shows a block diagram representing a conventional method for determining values of g and D for the long term predictor 16.

Usually, in pitch period search, output of the codebook 10 is set to zero to avoid joint optimization of pitch and codebook parameter which require enormous computation.

Past excitation signals v for the short term predictor are stored in the shift register 22. The excitation signals $v_{i-D}$ (i=1, 2 . . . N, where N is length of a signal block), which are D delayed signals, are taken out from the shift register 22, multiplied by gain g in the multiplier 20, and input to the short term predictor 24. The relationship between output $g \cdot y_i$ and input $g \cdot V_{i-D}$ of the short term predictor 24 is expressed by following equation:

$$g \cdot y_i = g \cdot v_{i-D} + g \cdot \sum_{j=1}^{p} a_j y_{i-j} \quad (1)$$

or

-continued $$y_i = v_{i-D} + \sum_{j=1}^{p} a_j y_{i-j}.$$

wherein $a_j$ (j=1, 2 . . . p) are linear prediction coefficients for the short term predictor 24 and p is the order of the short term predictor 24.

The total squared prediction error $E_D$ over a speech signal block is calculated from the following equation:

$$E_D = \sum_{i=1}^{N} (x_i - g \cdot y_i)^2, \quad (2)$$

wherein $x_i$ is a sample value of the speech signal.

A gain g which minimizes the $E_D$ is obtained from the following equation:

$$\partial E_D / \partial g = 0$$

$$2 \sum_{i=1}^{N} (x_i - g \cdot y_i) y_i = 0$$

Therefore, $$g = \sum_{i=1}^{N} x_i \cdot y_i / \sum_{i=1}^{N} y_i^2 \quad (3)$$

Substituting equation (3) into equation (2), $$E_D = \sum_{i=1}^{N} x_i^2 - \left( \sum_{i=1}^{N} x_i \cdot y_i \right)^2 / \sum_{i=1}^{N} y_i^2 \quad (4)$$

is obtained. Replacing the second term of the equation (4) by A, namely, $$A = \left( \sum_{i=1}^{N} x_i \cdot y_i \right)^2 / \sum_{i=1}^{N} y_i^2 \quad (5)$$

the total squared prediction error $E_D$ is minimized when A is maximum.

A searching part 28 sequentially selects one of all probable pitch periods for the delay time D, and an arithmetic part 30 estimates the total squared prediction error $E_D$ for each delay time D.

As mentioned above, in the conventional pitch period searching method, enormous operation according to the equation (5) for all probable pitch periods is required, and therefore, a scale of required hardware becomes large.

Figure 3A:
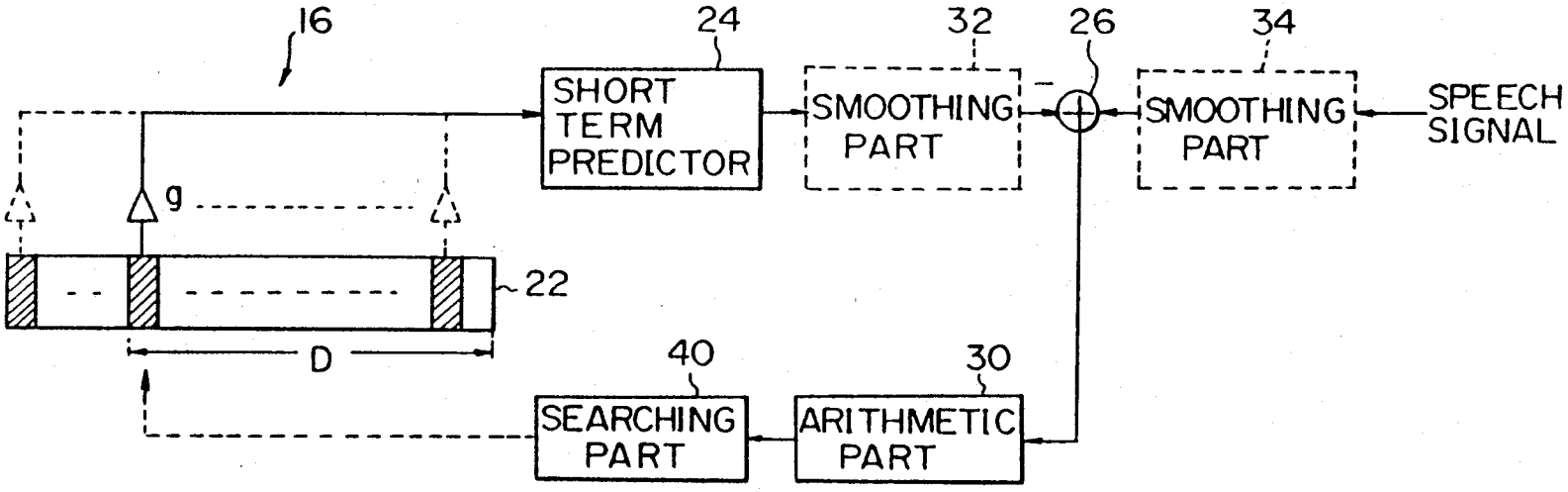
FIG. 3A is a block diagram representing a first searching stage according to the present invention.

The preferred embodiments of the present invention will now be described with reference to the accompanying drawings The pitch period searching process according to the present invention includes a first searching stage and a second searching stage. FIG. 3A shows the first searching stage.

The first searching process is performed skipping M samples wherein M is a constant value, and then a pitch period generating the least total squared prediction error is determined. Therefore, the number of arithmetic operations is remarkably decreased. But, as skipped samples are increased, correlation between neighboring samples becomes weak. To avoid this, smoothing parts 32 and 34 are provided as shown by dashed lines. Both of the smoothing parts 32 and 34 have a smoothing factor M, and smooth output signals of the short term predictor 24 and the speech signals, respectively, so that the searching accuracy is improved.

Figure 3B:
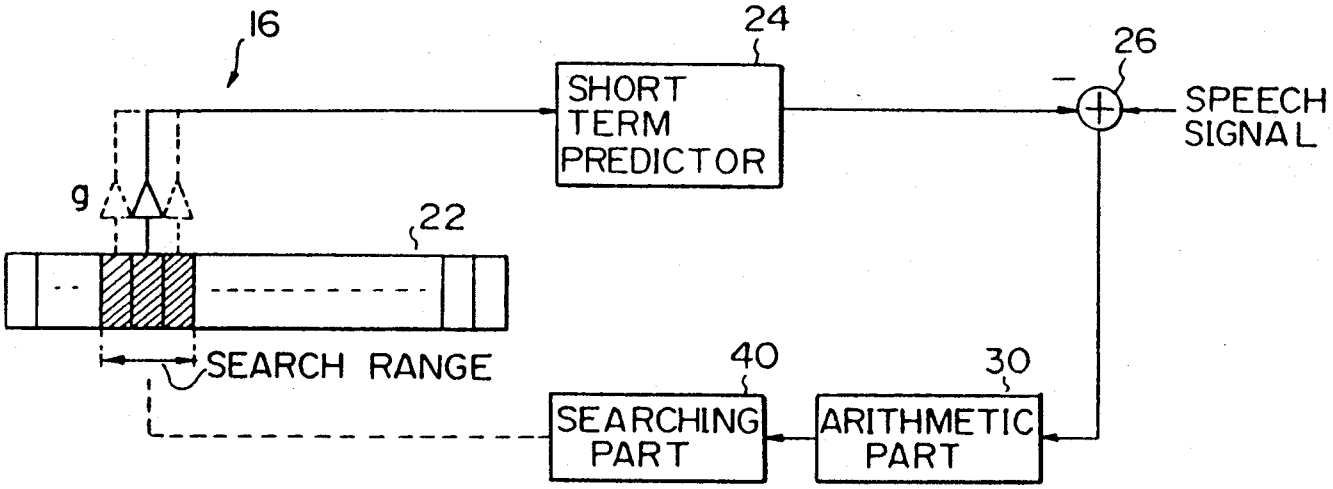
FIG. 3B is a block diagram representing a second searching stage according to the present invention.

FIG. 3B shows the second searching stage. In the second searching stage, a predetermined number of samples neighboring the pitch period determined in the first searching stage on both sides are searched for a pitch period generating the least total squared prediction error, so that the most adequate pitch period is finally determined.

Figure 4:
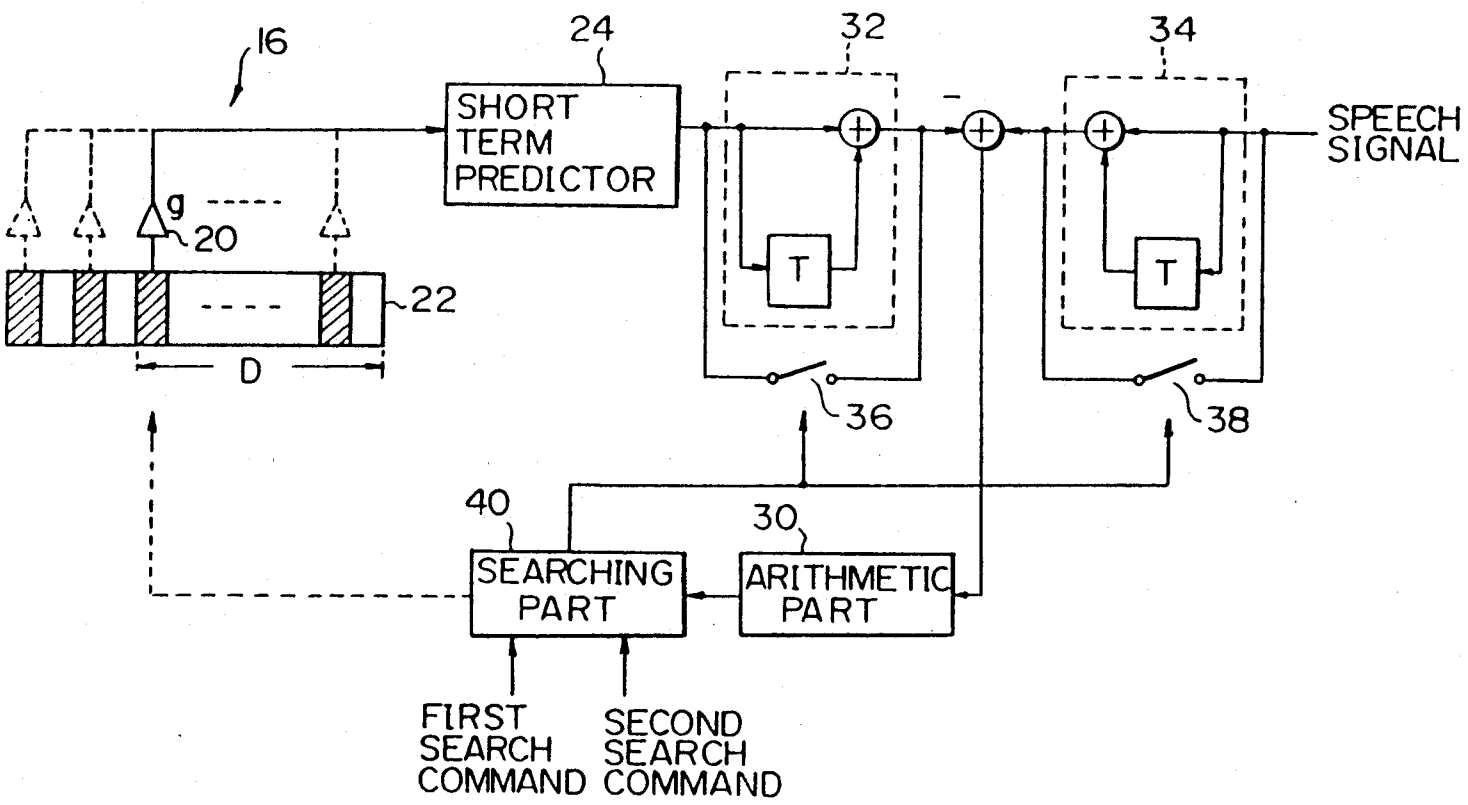
FIG. 4 is a block diagram showing a more concrete and more detailed example of the present invention.

FIG. 4 shows a more concrete and more detailed example of the present invention, but the present invention is not restricted to the example. In this example, pitch periods are searched within a range of 20 to 147 sampling intervals. The first searching process is performed skipping one sample. The smoothing parts 32 and 34 calculate moving averages of two neighboring samples of the output of the short term predictor 24 and the speech signals, respectively. Switches 36 and 38 which are controlled by the searching part 40 are provided in order to bypass the smoothing parts 32 and 34 in the second searching process.

When the searching part 40 receives a first search command, the searching part 40 opens the switches 36 and 38, sequentially sets a taking-out position of the shift register 22 at 20, 22, 24 . . . samples delay positions. The arithmetic part 30 calculates the total squared prediction error for each position, and a pitch period $D_1$ which generates the least total squared prediction error is determined in the searching part 40.

Next, when the searching part 40 receives a second search command, the searching part 40 closes the switches 36 and 38 to bypass the smoothing parts 32 and 34. and then searches the pitch period $D_1$ and each of two pitch periods neighboring the pitch period $D_1$ on both sides to find a pitch period $D_2$ which generates the least total squared prediction error among the five searched pitch periods. The pitch period $D_2$ is finally determined as the most adequate pitch period.

We claim:

1. A pitch period searching method for searching pitch periods which are probable in a speech signal, for a most adequate pitch period for a long term predictor included in a speech codec, comprising the steps of:

a) searching a first number of the pitch periods at a plurality of intervals to find a selected pitch period among the first number of the pitch periods which yields a provisional minimum total squared prediction error between an output signal calculated based on the selected pitch period, and the speech signal;

b) searching a second number of the pitch periods including the selected pitch period and pitch periods similar to said selected pitch period, to find the most adequate pitch period among the second number of the pitch periods which yields a minimum total squared prediction error between an output signal calculated based on the most adequate pitch period, and the speech signal; and c) performing at least one of speech coding and decoding of the speech signal based on the most adequate pitch period to generate coded and decoded speech signals, respectively.

2. A pitch period searching method for searching pitch periods which are probable in a speech signal, for the most adequate pitch period for a long term predictor included in a speech codec, comprising the steps of:

a) searching the probable pitch periods at a plurality of intervals to find a selected pitch period among the searched pitch periods;

b) searching a second number of pitch periods including the selected pitch period and pitch periods similar to said selected pitch period, to find the most adequate pitch period among the second number of pitch periods;

c) performing long term prediction of a pitch period of the speech signal based on the most adequate pitch period; and d) performing at least one of speech coding and decoding of the speech signal based on said step (c) to generate coded and decoded speech signals, respectively;

said speech codec including a short term predictor, and said steps (a) and (b) comprise the substeps of:

a') estimating a total squared prediction error between the speech signal and a predictive signal of the speech signal, predicted with said long term predictor and said short term predictor, for each searched pitch period, and b') selecting a pitch period which generates the least total squared prediction error among the searched pitch periods as the most adequate pitch period.

3. A pitch period searching circuit for searching pitch periods which are probable in a speech signal for the most adequate pitch period for a long term predictor included in a speech codec, comprising:

arithmetic means for calculating an estimation of a suitability of a pitch period based on a total squared prediction error; and searching means for searching the probable pitch periods at a plurality of intervals to find a selected pitch period among the searched pitch periods based on the estimation by said arithmetic means, in response to a first search command, and for searching a second number of pitch periods including said selected pitch period and pitch periods similar to said selected pitch period, to find the most adequate pitch period among the second number of pitch periods based on the estimation provided by said arithmetic means, in response to a second search command;

predicting means for predicting a pitch period of the speech signal based on the most adequate pitch period; and coding/decoding means for at least one of coding and decoding of the speech signal based on the pitch period predicted by said predicting means, to generate at least one of coded and decoded speech signals, respectively.

4. A pitch period searching circuit for searching pitch periods which are probable in a speech signal for the most adequate pitch period for a long term predictor included in a speech codec, comprising:

arithmetic means for calculating an estimation of a suitability of a pitch period; and searching means for search the probable pitch periods at a plurality of intervals to find a selected pitch period among the searched pitch periods based on the estimation by said arithmetic means, in response to a first search command, and for searching a second number of pitch periods including said selected pitch period and pitch periods similar to said selected pitch period, to find the most adequate pitch period among the second number of pitch periods based on the estimation provided by said arithmetic means, in response to a second search command;

predicting means for predicting a pitch period of the speech signal based on the most adequate pitch period; and coding/decoding means for at least one of coding and decoding of the speech signal based on the pitch period predicted by said predicting means, to generate at least one of coded and decoded speech signals, respectively;

said speech codec including a short term predictor, said arithmetic means estimating a total squared prediction error between a speech signal and a predictive signal of the speech signal, predicted with said long term predictor and said short term predictor, and said searching means selecting a pitch period which generates the least total squared prediction error among the searched pitch periods as the most adequate pitch period.

5. A pitch period searching method for searching pitch periods which are probable in a speech signal, for the most adequate pitch period for a long term predictor included in a speech codec, comprising the steps of:

a) searching the probable pitch periods at a plurality of intervals to find a selected pitch period among the searched pitch periods;

b) searching a second number of pitch periods including the selected pitch period and pitch periods similar to said selected pitch period, to find the most adequate pitch period among the second number of pitch periods;

c) performing long term prediction of a pitch period of the speech signal based on the most adequate pitch period; and d) performing at least one of speech coding and decoding of the speech signal based on said step (c) to generate coded and decoded speech signals, respectively said speech codec including a short term predictor, and said steps (a) and (b) comprise the substeps of:

a') estimating a total squared prediction error between the speech signal and a predictive signal of the speech signal, predicted with said long term predictor and said short term predictor, for each searched pitch period, and b') selecting a pitch period which generates the least total squared prediction error among the searched pitch periods as the most adequate pitch period; and said probable pitch periods being searched at predetermined constant intervals, in said step (a).

6. A searching method as claimed in claim 5, wherein said substep (a') comprises a step of smoothing said speech signal and said prediction signal at a time constant corresponding to said intervals, before calculating said prediction error.

7. A pitch period searching circuit for searching pitch periods which are probable in a speech signal for the most adequate pitch period for along term predictor included in a speech codec, comprising:

arithmetic means for calculating an estimation of a suitability of a pitch period based on a total squared prediction error; and searching means for searching the probable pitch periods at a plurality of intervals to find a selected pitch period among the searched pitch periods based on the estimation by said arithmetic means, in response to a first search command, and for searching a second number of pitch periods including said selected pitch period and pitch periods similar to said selected pitch period, to find the most adequate pitch period among the second number of pitch periods based on the estimation provided by said arithmetic means, in response to a second search command;

predicting means for predicting a pitch period of the speech signal based on the most adequate pitch period;

coding/decoding means for at least one of coding and decoding of the speech signal based on the pitch period predicted by said predicting means, to generate at least one of coded and decoded speech signals, respectively; and said searching means searching the probable pitch periods at predetermined constant intervals.

8. A searching circuit as claimed in claim 7, further comprising:

first and second smoothing means for smoothing said speech signal and said predictive signal, respectively, at a time constant corresponding to said intervals, and first and second switch means for bypassing said first and second smoothing means, respectively, wherein said searching means opens said first and second switch means in response to said first search command, and closes said first and second means in response to said second search command.

9. A searching circuit as claimed in claim 7, wherein:

said speech codec comprise a short term predictor, said arithmetic means includes means for estimating a total squared prediction error between a speech signal and a predictive signal of the speech signal, predicted with said long term predictor and said short term predictor, and said searching means includes means for selecting a pitch period which generates the least total squared prediction error among the searched pitch periods as the most adequate pitch period.

10. A pitch period searching method for searching a plurality of pitch periods which are probable in speech signals for the most adequate pitch period for a long term predictor included in a speech codec, comprising the steps of:

a) searching the plurality of pitch periods which are probable in speech signals based on an estimation technique using a total squared prediction error, at a variable interval to select a plurality of pitch periods; 'b) determining a similarity of the selected plurality of pitch periods to the speech signal to provide a result;

c) searching a selected number of pitch periods which include a most adequate pitch period using the estimation technique, based on the result of said step (b);

d) performing long term prediction of a pitch period of the speech signal based on the most adequate pitch period, and e) performing at least one of speech coding and decoding of the speech signal based on said step (d), to generate at least one of coded and decoded speech signals, respectively.

* * * * *